US009640300B2

(12) United States Patent
Magner

(10) Patent No.: US 9,640,300 B2
(45) Date of Patent: May 2, 2017

(54) CABLE HAVING A THIN FILM MATERIAL AND METHODS OF PREVENTING DISCOLORATION DAMAGE TO A CABLE HAVING A THIN FILM MATERIAL

(71) Applicant: Rockbestos Surprenant Cable Corp., East Granby, CT (US)

(72) Inventor: Scott Magner, South Glastonbury, CT (US)

(73) Assignee: Rockbestos Surprenant Cable Corp., East Granby, CT (US)

( * ) Notice: Subject to any disclaimer, the term of this patent is extended or adjusted under 35 U.S.C. 154(b) by 225 days.

(21) Appl. No.: 13/933,284

(22) Filed: Jul. 2, 2013

(65) Prior Publication Data

US 2014/0014391 A1 Jan. 16, 2014

Related U.S. Application Data

(60) Provisional application No. 61/671,361, filed on Jul. 13, 2012.

(51) Int. Cl.

| | |
|---|---|
| ***H01B 7/00*** | (2006.01) |
| ***H01B 13/06*** | (2006.01) |
| ***H01B 7/18*** | (2006.01) |
| *H01B 7/36* | (2006.01) |
| *H01B 7/38* | (2006.01) |

(52) U.S. Cl.

CPC ..... *H01B 7/00* (2013.01); *H01B 7/18* (2013.01); *H01B 7/1875* (2013.01); *H01B 13/06* (2013.01); *H01B 7/361* (2013.01); *H01B 7/38* (2013.01); *Y10T 29/49117* (2015.01)

(58) Field of Classification Search

CPC ..... B32B 7/10; B32B 27/08; B65D 5/54
USPC ..... 174/102 R, 112, 103
See application file for complete search history.

(56) References Cited

U.S. PATENT DOCUMENTS

| | | | | |
|---|---|---|---|---|
| 3,576,387 | A * | 4/1971 | Derby | 174/36 |
| 3,642,564 | A * | 2/1972 | Walker | B05D 5/00 156/248 |
| 4,253,890 | A | 3/1981 | Brorein | |
| 4,579,759 | A * | 4/1986 | Breuers | 428/375 |
| 4,767,894 | A * | 8/1988 | Schombourg | H01B 3/44 156/51 |
| 4,911,525 | A | 3/1990 | Hicks et al. | |
| 4,950,343 | A | 8/1990 | Shimirak et al. | |
| 4,952,020 | A | 8/1990 | Huber | |
| 5,173,961 | A * | 12/1992 | Chiasson | G02B 6/443 385/112 |
| 5,495,547 | A * | 2/1996 | Rafie et al. | 385/101 |

(Continued)

FOREIGN PATENT DOCUMENTS

| | | | |
|---|---|---|---|
| JP | 2001210149 | A | 8/2001 |
| JP | 2008262881 | A | 10/2008 |

*Primary Examiner* — Timothy Thompson
*Assistant Examiner* — Michael F McAllister
(74) *Attorney, Agent, or Firm* — Hayes Soloway PC

(57) ABSTRACT

A cable apparatus and method for preventing discoloration to a cable is disclosed. The apparatus includes a conductor. An exterior layer surrounds the conductor. A thin film material is removably positioned over an exterior surface of the exterior layer. At least one film removal area is positioned within the thin film material, wherein the at least one film removal area is positioned along a length of the exterior layer.

20 Claims, 7 Drawing Sheets

(56) References Cited

U.S. PATENT DOCUMENTS

| | | | | |
|---|---|---|---|---|
| 5,719,353 | A * | 2/1998 | Carlson | H01B 11/1869 174/102 P |
| 5,750,931 | A | 5/1998 | McGregor et al. | |
| 5,777,272 | A * | 7/1998 | Rouskey | 174/112 |
| 6,005,191 | A * | 12/1999 | Tzeng et al. | 174/102 R |
| 6,479,607 | B1 * | 11/2002 | Milan | C08K 5/0016 524/115 |
| 6,545,222 | B2 * | 4/2003 | Yokokawa | G02B 6/4495 174/110 R |
| 6,825,418 | B1 | 11/2004 | Dollins et al. | |
| 8,455,080 | B2 * | 6/2013 | Baer | B32B 5/26 428/189 |
| 2002/0092670 | A1 | 7/2002 | Fang et al. | |
| 2002/0098311 | A1 * | 7/2002 | Lindner | A44B 18/0092 428/40.1 |
| 2002/0170739 | A1 | 11/2002 | Ryeczek | |
| 2004/0062497 | A1 * | 4/2004 | Plemmons | G02B 6/4495 385/109 |
| 2005/0069666 | A1 * | 3/2005 | Ferrand | 428/40.1 |
| 2005/0199412 | A1 * | 9/2005 | Ke | H01B 7/1855 174/108 |
| 2006/0086527 | A1 | 4/2006 | Sterkers et al. | |
| 2009/0114418 | A1 * | 5/2009 | Smith | G09F 3/00 174/112 |
| 2010/0296785 | A1 | 11/2010 | Meyyappan et al. | |
| 2011/0011638 | A1 | 1/2011 | Gemme | |
| 2011/0061890 | A1 | 3/2011 | Amato | |

* cited by examiner

CABLE HAVING A THIN FILM MATERIAL AND METHODS OF PREVENTING DISCOLORATION DAMAGE TO A CABLE HAVING A THIN FILM MATERIAL

CROSS REFERENCE TO RELATED APPLICATION

This application claims benefit of U.S. Provisional Application Ser. No. 61/671,361 entitled, "Cable having a thin film material and methods of preventing discoloration damage to a cable having a thin film material" filed Jul. 13, 2012, the entire disclosure of which is incorporated herein by reference.

FIELD OF THE DISCLOSURE

The present disclosure is generally related to preventing damage to cables and hoses, and more particularly is related to a cable having a thin film material and methods of preventing discoloration damage to a cable with a thin film material.

BACKGROUND OF THE DISCLOSURE

Structures, such as cables, wires, and similar structures, are often subjected to environments prone to discoloring the exterior of the structure. For example, cables may be used in devices that are painted or in environments where discoloration is likely, such as environments with high levels of grease, dirt, or dyes. When a plurality of cables are used, it is often imperative for the cable to be identified based on exterior visual indicators, such as textual markings or colors, such that the cables are not confused with one another. However when the exterior of the cables are discolored, identification of the cable is difficult, if not impossible. The inability to identify a cable may create complications, but misidentification of the cable or cables can result in serious malfunctions and errors with functionality and maintenance of the devices and systems that utilize the cables. These malfunctions and errors can lead to costly down time of the devices and systems, or worse, human injury.

Thus, a heretofore unaddressed need exists in the industry to address the aforementioned deficiencies and inadequacies.

SUMMARY OF THE DISCLOSURE

Embodiments of the present disclosure provide a cable apparatus and method of preventing discoloration damage to a cable. Briefly described, in architecture, one embodiment of the apparatus, among others, can be implemented as follows. The cable apparatus includes a conductor. An exterior layer surrounds the conductor. A thin film material is removably positioned over an exterior surface of the exterior layer. At least one film removal area is formed within the thin film material, wherein the at least one film removal area is positioned along a length of the exterior layer.

The present disclosure can also be viewed as a painted apparatus. Briefly described, in architecture, one embodiment of the apparatus, among others, can be implemented as follows. The painted apparatus includes a mechanical device. A conductor is positioned in use with the mechanical device. An exterior layer surrounds the conductor. A thin film material is removably positioned over an exterior surface of the exterior layer. At least one film removal area is formed within the thin film material, wherein the at least one film removal area is positioned along a length of the exterior layer. At least one layer of paint is applied to an exterior of the mechanical device, wherein a portion of the layer of paint is adhered to the thin film material.

The present disclosure can also be viewed as providing methods of preventing discoloration damage to a cable. In this regard, one embodiment of such a method, among others, can be broadly summarized by the following steps: applying a thin film material over an exterior surface of an exterior layer of a conductor, wherein the thin film material has at least one film removal area formed therein and positioned along a length of the exterior layer; subjecting the conductor and exterior layer having the thin film material to a discoloration material, wherein the discoloration material adheres to the thin film material; and removing the thin film material with discoloration material adhered to the exterior surface of the exterior layer, thereby exposing the exterior surface of the exterior layer, wherein the exposed exterior surface is free from discoloration.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION

Figure 1:
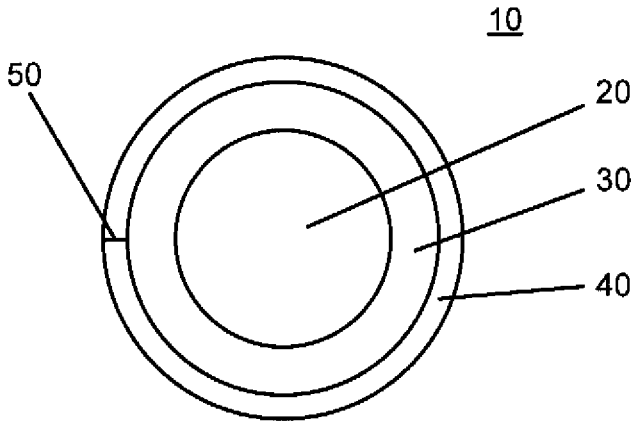
FIG. 1 is a cross-sectional illustration of a cable apparatus, in accordance with a first exemplary embodiment of the present disclosure.

FIG. 1 is a cross-sectional illustration of a cable apparatus 10, in accordance with a first exemplary embodiment of the present disclosure. The cable apparatus 10, which may be referred to herein simply as 'apparatus 10,' includes a conductor 20. An exterior layer 30 surrounds the conductor 20. A thin film material 40 is removably positioned over an exterior surface 32 (shown in FIG. 3) of the exterior layer 30. At least one film removal area 50 is formed within the thin film material 40, wherein the at least one film removal area 50 is positioned along a length of the exterior layer 30.

The apparatus 10 may be used to prevent discoloration damage often seen in conventional cables, including various types of cables, wires, hoses, pipes, and other cables. Discoloration damage can occur when the cable is subjected to painting or other discoloration processes, on purpose and inadvertently. For example, a device may utilize a plurality of cables therein, and when the device is painted, the cables therein may be coated with paint. This may present problems with identifying the specific cable, especially when a number of cables are included within the device. Other forms of discoloration may be created via other means, or through other processes, such as when cables are exposed to solvents, dirty environments, harsh environments, or any other environments that can alter the visual appearance of the color of the cable.

The apparatus 10 may include any type of cable, wire, transmission line, hose, or similar structure that may be used for various signal, energy, or material transmission purposes. For example, the apparatus 10 may be used for transmitting communication signals within a vehicle. Accordingly, the conductor 20 may be any type of material that conducts a communication signal, quantity of light, or any type of electrical signal. For example, the conductor 20 may be a metallic or fiber optic material capable of facilitating movement of electric charges, light or any other communication medium, such as copper, aluminum, alloys, fiber electric hybrid materials, fiber optical material or any other material known within the industry. Thus, the conductor 20 may be capable of facilitating movement of energy capable of powering a device or facilitating a communication or control signal between devices. Any number of conductors 20 may be used, and the conductor 20 may be located at substantially the center of the apparatus 10, but may also be located off-center or in another position as well. Other configurations or orientations of the conductor(s) 20 may be included, such as three conductors 20 bound together.

The exterior layer 30 may include any type of jacketing materials or other exteriorly-positioned materials. For example, the exterior layer 30 may be constructed from plastics, rubbers, synthetic materials, metallic materials, and the like. The exterior layer 30 may be a hardened material that prevents exposure of the conductor 20 to the surrounding atmosphere, and prevents physical damage to the apparatus 10, such as from a foreign object. For example, the exterior layer 30 may be a durable jacket that prevents sharp objects from piercing through the exterior layer 30 and contacting the conductor. The durable jacket may include armored or metal-sheathed jackets.

The thin film material 40 is removably formed over an exterior surface 32 (shown in FIG. 3) of the exterior layer 30. The thin film material 40 may be an easily-removable, non-permanent material that is positioned over the exterior layer 30 for the purpose of preventing discoloration to the exterior layer 30. The thin film material 40 may be adhesively adhered to the exterior layer 30, such that the thin film material 40 remains positioned on the exterior layer 30 during conditions that are likely to create discoloration on the apparatus 10, such as painting. The thin film material 40 may be removed from the exterior surface 32 of the exterior layer 30 at any point during manufacturing or use of the apparatus 10. For example, the thin film material 40 may be removed after the apparatus 10 is subjected to paint or after the apparatus 10 has been installed, and therefore the apparatus 10 is most likely to be exposed to installation materials that may discolor the apparatus 10, such as dirt, grease, or oils.

The thin film material 40 may be constructed from a number of different materials, including thermoset or thermoplastic, filled or unfilled materials, such as polypropylene (PP), polyethylene (PE), ethylene vinyl acetate (EVA), ethylene ethyl acrylate (EEA), polyvinyl chloride (PVC), thermoplastic rubber (TPR), thermoplastic vulcanizate (TPV), thermoplastic elastomers (TPE), fluorinated ethylene propylene (FEP), perfluoroalkoxy (PFA), ethylene tetrafluoroethylene (ETFE), ethylene chlorotrifluoroethylene (ECTFE), urethane, polyvinylidene difluoride (PVDF), polyether imide (PEI), polyphenylene oxide (PPO), polyphenylene ether (PPE), polysulfone (PSU), polyarylsulphones (PPSU), chlorinated polyethylene (CPE), polyimide, polyamide, ethylene-propylene elastomer (EPR), ethylene-octene (EO), electron beam (EB), polyolefin, linear low-density polyethylene (LLDPE), linear high-density polyethylene (LHDPE), linear low-density polypropolyene (LLDPP), linear high-density polypropolyene (LHDPP), or perfluoro methyl alkoxy (MFA), or any combination thereof.

The thin film material 40 may be considered a sacrificial layer of material that is applied to the exterior of the exterior layer 30 to prevent paint, solvents, and other materials from adhering to the exterior of the exterior layer 30. When paint, solvents, or other materials do adhere to the thin film material 40, such as when the apparatus 10 is subjected to a painting process, the thin film material 40 may be removed to expose the exterior surface of the exterior layer 30. The thin film material 40 may be formed as a solid or foamed on the exterior of the exterior layer 30, and retained on the exterior layer 30 with or without an adhesive material. For example, the thin film material 40 may be applied to the exterior layer 30 with a variety of manufacturing processes, including pellet extrusion, ram extrusion, concentric, or longitudinally applied tape. The thin film material 40 may have a thickness that is less than the thickness of the exterior layer 30, such as, for example, approximately 1.0 mm or less, although the thickness of the thin film material 40 may vary depending on the specific application and use of the apparatus 10.

Figure 2:
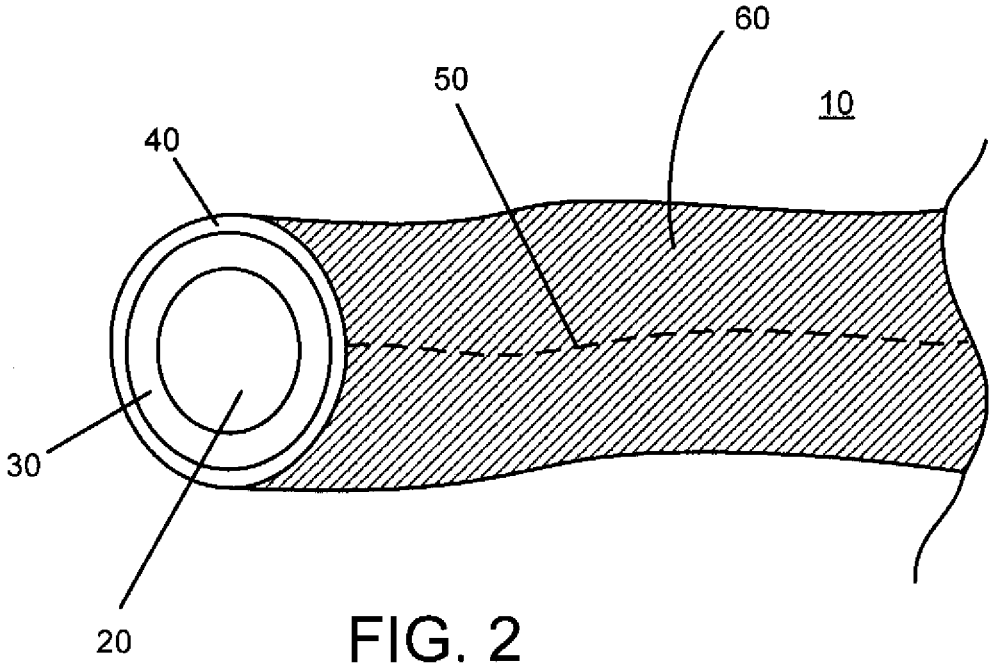
FIG. 2 is a plan view illustration of the cable apparatus, in accordance with the first exemplary embodiment of the present disclosure.
Figure 3:
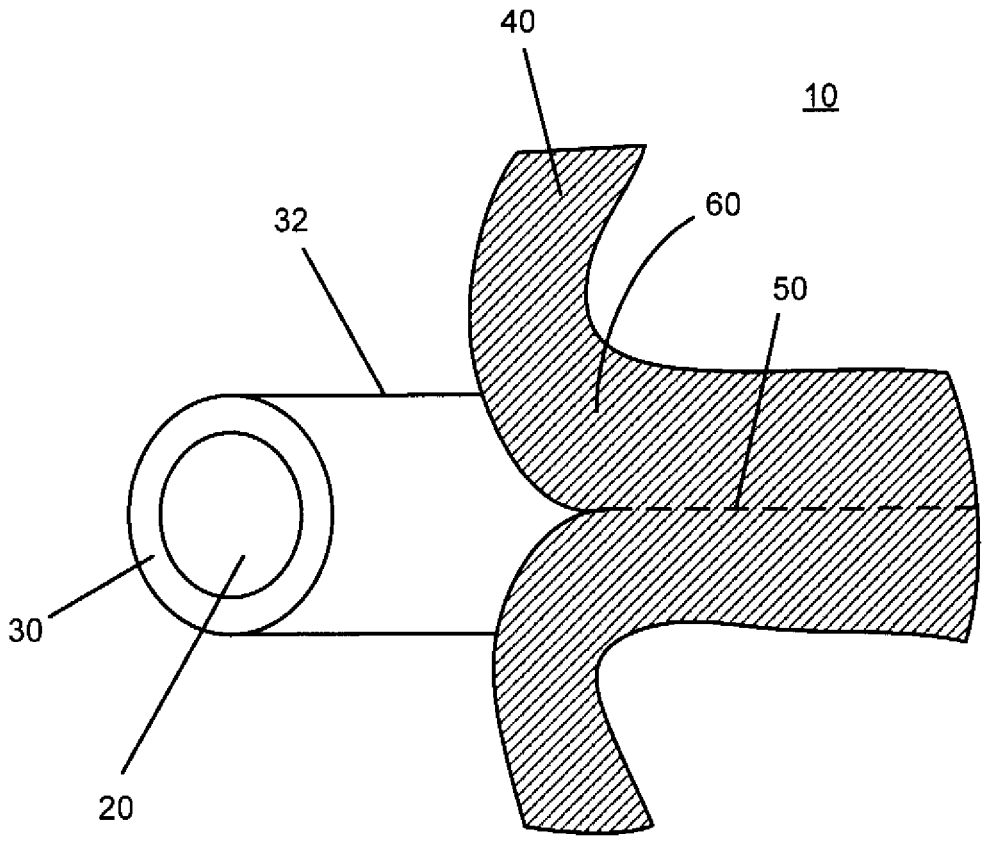
FIG. 3 is a plan view illustration of the cable apparatus, in accordance with the first exemplary embodiment of the present disclosure.

The film removal area 50 may be any structure, area, or component formed in or positioned on the thin film material 40 that allows for removal of the thin film material 40 from the exterior surface 32 of the exterior layer 30. For example, as is shown in FIGS. 1-3, the film removal area 50 may commonly be one or more perforations that run along the length of the apparatus 10. The perforations may have sufficient durability such that the thin film material 40 remains on the exterior layer 30 throughout various conditions that the apparatus 10 may be exposed to, thereby preventing inadvertent removal of the thin film material 40. When a user desires to remove the thin film material 40, he or she may grasp a portion of the thin film material 40 and peel it away from the elongated layer 30.

A variety of other designs and configurations of the film removal area 50 are disclosed relative to FIGS. 4-10 herein. In any configuration or design, the film removal area 50 may facilitate removal of the thin film material 40 easier and more efficiently than the thin film material 40 could be removed without the film removal area 50. The film removal area 50 may be positioned along a length of the exterior layer 30 in a variety of ways. For example, commonly the film removal area 50 will be positioned substantially aligned with the length of the conductor 20 and exterior layer 30. Other configurations of the film removal area 50 may include concentric or helical positions about the conductor 20 and exterior layer 30.

FIG. 2 is a plan view illustration of the cable 10, in accordance with the first exemplary embodiment of the present disclosure. FIG. 3 is a plan view illustration of the cable 10, in accordance with the first exemplary embodiment of the present disclosure. With reference to FIGS. 1-3, the apparatus 10 may commonly be used in an environment where the apparatus 10 is subjected to discoloration. For example, the apparatus 10 may be used in an environment that is exposed to paint, and when paint is applied too proximate to the apparatus 10, it may inadvertently adhere to the exterior of the apparatus 10. When conventional cables are exposed to paint, they may be discolored to the point where the original color of the cable or textual markings on the cable cannot be visually identified. However, when the apparatus 10 is subjected to discoloration, the paint 60 may adhere to the thin film material 40 and not the exterior surface 32 of the exterior layer 30. Once the paint 60 has dried, the thin film material 40 may be removed to expose the original and true color of the exterior layer 30. Of course, the thin film material 40 may be used in the same manner but for the purpose of preventing any textual message or depiction on the exterior layer 30 from being covered due to discoloration.

As is shown in FIG. 3, the thin film material 40 may be peeled off the exterior surface 32 of the exterior layer 30 along the film removal area 50. The discoloration material or paint 60 that has adhered to the thin film material 40 may be carried away from the exterior layer 30 with the removal of the thin film material 40. As one having skill in the art can see, the use of the thin film material 40 may allow for safer usage of cables, since the technicians and workers that are required to visually identify the purpose or characteristic of the cable based on an exterior visual indicator will be able to do so without visual obstructions from discoloration.

Figure 4:
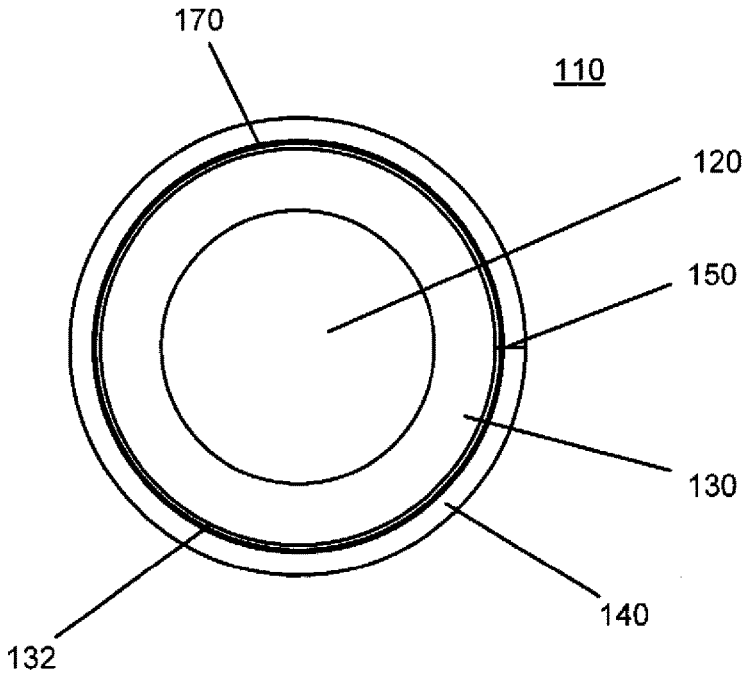
FIG. 4 is a cross-sectional illustration of a cable apparatus, in accordance with a second exemplary embodiment of the present disclosure.

FIG. 4 is a cross-sectional illustration of a cable apparatus 110, in accordance with a second exemplary embodiment of the present disclosure. The cable apparatus 110, which may be referred to simply as 'apparatus 110' may include any of the features, structures, or qualities described with respect to any embodiment of this disclosure. As is shown in FIG. 4, the apparatus 110 includes a conductor 120. An exterior layer 130 surrounds the conductor 120. A thin film material 140 is removably positioned over an exterior surface 132 of the exterior layer 130. At least one film removal area 150 is formed within the thin film material 140, wherein the at least one film removal area 150 is positioned along a length of the exterior layer 130. Additionally, the apparatus 110 includes an adhesive material 170 positioned between the thin film material 140 and the exterior surface 132 of the exterior layer 130. The adhesive material 170 may include any type of adhesive substance that is capable of retaining the thin film material 140 to the exterior layer 130, but allowing removal of the thin film material 140 when a user desires to remove it from the exterior layer 130. The thin film material 140 may be easily removed with or without the use of tools, chemicals, heat, or other catalysts. For example, the thin film material 140 may be capable of being peeled off the exterior layer 130, wherein the force of removing the thin film material 140 only needs to be greater than the strength of an adhesive fixing the thin film material 140 to the exterior layer 130.

Figure 5:
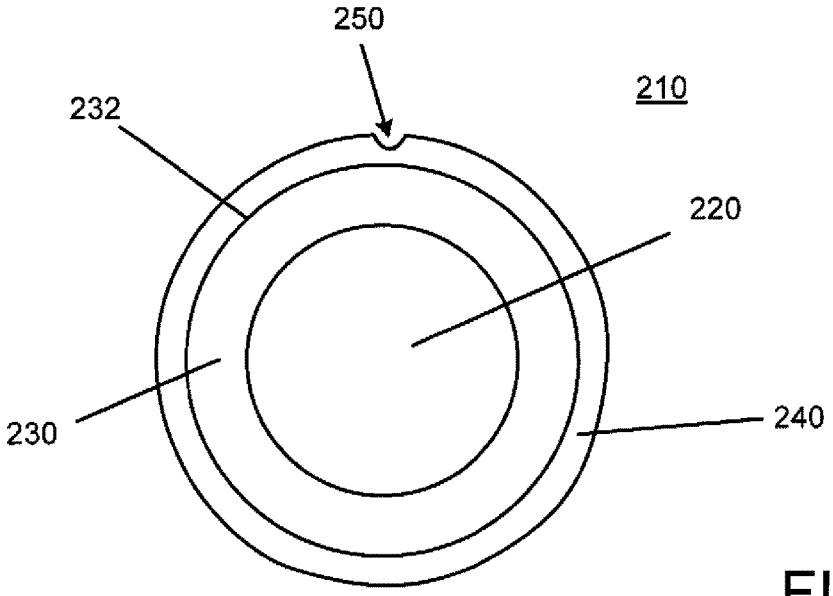
FIG. 5 is a cross-sectional illustration of a cable apparatus, in accordance with a third exemplary embodiment of the present disclosure.

FIG. 5 is a cross-sectional illustration of a cable apparatus 210, in accordance with a third exemplary embodiment of the present disclosure. The cable apparatus 210, which may be referred to simply as 'apparatus 210' may include any of the features, structures, or qualities described with respect to any embodiment of this disclosure. As is shown in FIG. 5, the apparatus 210 includes a conductor 220. An exterior layer 230 surrounds the conductor 220. A thin film material 240 is removably positioned over an exterior surface 232 of the exterior layer 230. At least one film removal area 250 is formed within the thin film material 240, wherein the at least one film removal area 250 is positioned along a length of the exterior layer 230. The film removal area 250 of FIG. 5 is a weakened region that is more susceptible to being broken than other, non-weakened portions of the thin film material 240. For example, the weakened region may have a lesser thickness than other portions of the thin film material 240. The weakened region may be formed within the thin film material 240 initially, or it may be created after the thin film material 240 is formed. Furthermore, the weakened region may be the same thickness or size as the rest of the thin film materials 240, but formed from a weaker substance than other portions of the thin film material 240.

Figure 6:
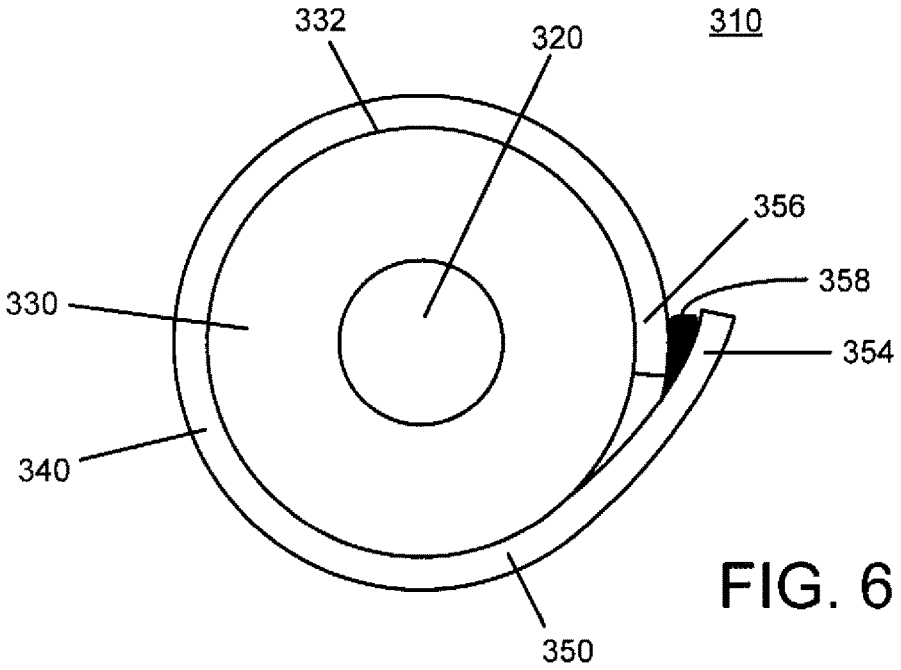
FIG. 6 is a cross-sectional illustration of a cable apparatus, in accordance with a fourth exemplary embodiment of the present disclosure.

FIG. 6 is a cross-sectional illustration of a cable apparatus 310, in accordance with a fourth exemplary embodiment of the present disclosure. The cable apparatus 310, which may be referred to simply as 'apparatus 310' may include any of the features, structures, or qualities described with respect to any embodiment of this disclosure. As is shown in FIG. 6, the apparatus 310 includes a conductor 320. An exterior layer 330 surrounds the conductor 320. A thin film material 340 is removably positioned over an exterior surface 332 of the exterior layer 330. At least one film removal area 350 is formed within the thin film material 340, wherein the at least one film removal area 350 is positioned along a length of the exterior layer 330. In FIG. 6, the film removal area 350 is an overlapped section of the thin film material 340. A first portion 354 of the thin film material 350 may be positioned overlapped on a second portion 356 of the thin film material 350 with an adhesive 358 positioned therebetween. When the first portion 354 is removed from the second portion 356, the thin film material 350 may be removed from the exterior layer 330.

Figure 7:
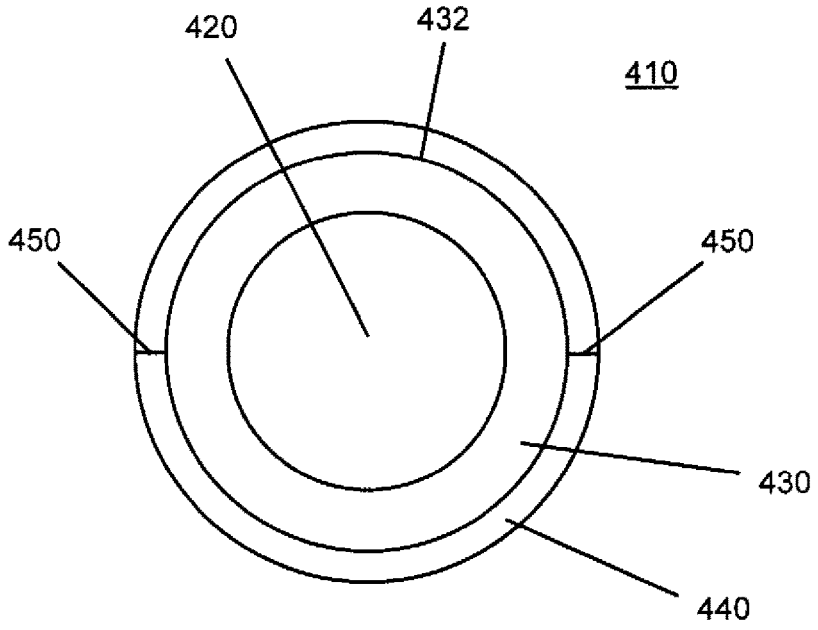
FIG. 7 is a cross-sectional illustration of a cable apparatus, in accordance with a fifth exemplary embodiment of the present disclosure.

FIG. 7 is a cross-sectional illustration of a cable apparatus 410, in accordance with a fifth exemplary embodiment of the present disclosure. The cable apparatus 410, which may be referred to simply as 'apparatus 410' may include any of the features, structures, or qualities described with respect to any embodiment of this disclosure. As is shown in FIG. 7, the apparatus 410 includes a conductor 420. An exterior layer 430 surrounds the conductor 420. A thin film material 440 is removably positioned over an exterior surface 432 of the exterior layer 430. At least one film removal area 450 is formed within the thin film material 440, wherein the at least one film removal area 450 is positioned along a length of the exterior layer 430. As is shown in FIG. 7, there may be a plurality of film removal areas 450, such as two or more perforated slits formed within the thin film material 440. The perforated slits may be positioned equally spaced about the exterior layer 430, opposing each other, parallel to each other along the length of the exterior layer 430, or proximate to each other, all locations of which are considered within the scope of the present disclosure.

Figure 8:
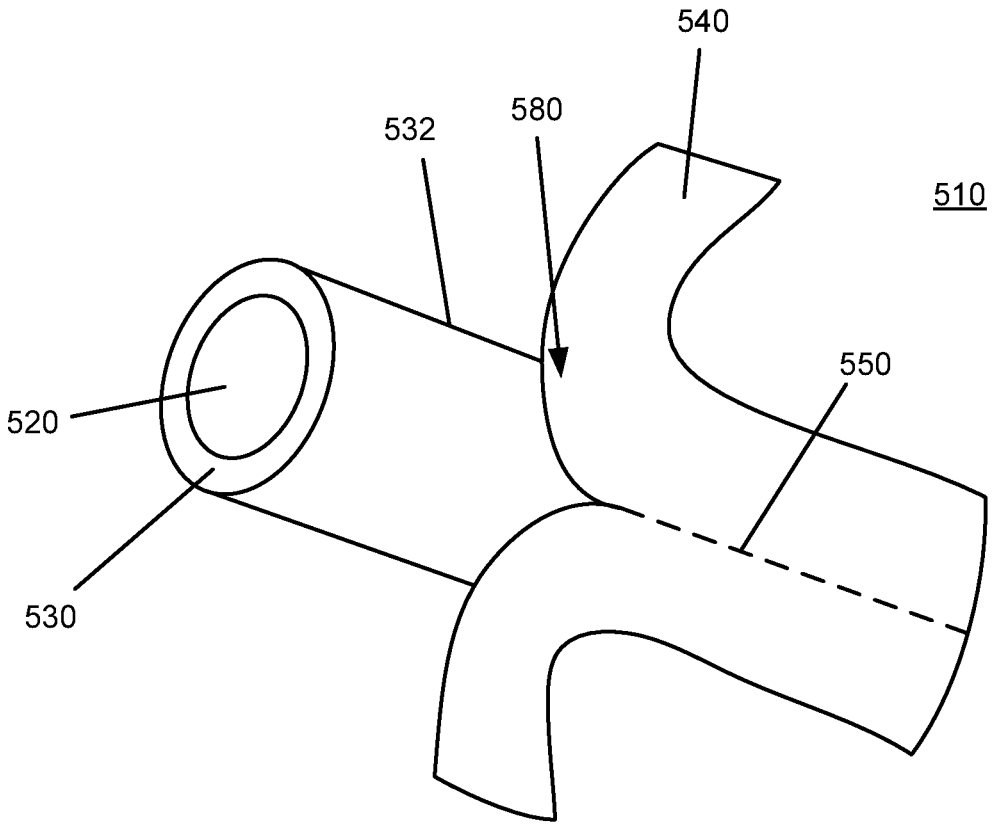
FIG. 8 is a plan view illustration of a cable apparatus, in accordance with a sixth exemplary embodiment of the present disclosure.

FIG. 8 is a plan view illustration of a cable apparatus 510, in accordance with a sixth exemplary embodiment of the present disclosure. The cable apparatus 510, which may be referred to simply as 'apparatus 510' may include any of the features, structures, or qualities described with respect to any embodiment of this disclosure. As is shown in FIG. 8, the apparatus 510 includes a conductor 520. An exterior layer 530 surrounds the conductor 520. A thin film material 540 is removably positioned over an exterior surface 532 of the exterior layer 530. At least one film removal area 550 is formed within the thin film material 540, wherein the at least one film removal area 550 is positioned along a length of the exterior layer 530.

It may be desirable for the thin film material 540 to be substantially translucent, semi translucent, or opaque, thereby allowing one to visually determine the color of the exterior layer 530 while the thin film material 540 is still applied to the exterior layer 530. Accordingly, the thin film material 540 may be formed to allow a color or a textual marking 580 on the exterior surface 532 to be visually identifiable when viewed through the substantially translucent thin film material. As is shown in FIG. 8, the textual marking 580 on the exterior surface 532 may be viewable through the thin film material 540, which can allow one to identify the type of cable or a characteristic of the cable without having to remove the thin film material 540. In addition to having textual markings 580 on the exterior surface 532, the thin film material 540 may also have any number of markings, textures, depictions, textual instructions, or other indicia thereof. For example, the thin film material 540 may have a textual instruction to the user of the apparatus 510 to remove the thin film material 540 after paint, solvents, or materials have discolored it.

Figure 9:
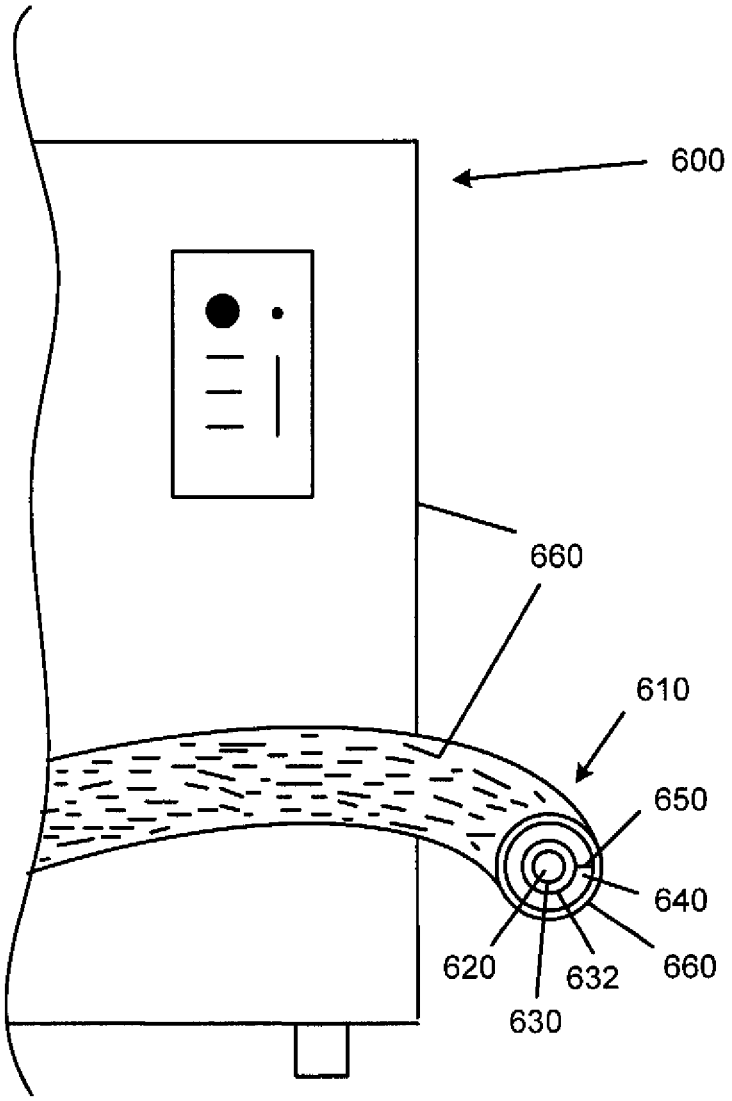
FIG. 9 is a partial cross-sectional view illustration of a mechanical device having a cable, in accordance with a seventh exemplary embodiment of the present disclosure.

FIG. 9 is a partial cross-sectional view illustration of a mechanical device 600 having a cable apparatus 610, in accordance with a seventh exemplary embodiment of the present disclosure. The cable apparatus 610, which may be referred to simply as 'apparatus 610' may include any of the features, structures, or qualities described with respect to any embodiment of this disclosure. As is shown in FIG. 9, the apparatus 610 includes a conductor 620. An exterior layer 630 surrounds the conductor 620. A thin film material 640 is removably positioned over an exterior surface 632 of the exterior layer 630. At least one film removal area 650 is formed within the thin film material 640, wherein the at least one film removal area 650 is positioned along a length of the exterior layer 630.

The mechanical device 600 may include any type of machine, apparatus, or other device that utilizes the apparatus 610 therein. Commonly, the apparatus 610 may be used as a component within the mechanical device 600 and partially exposed to a paintable surface on the mechanical device 600. When the paintable surface of the mechanical device 600 is painted, the paint applied may adhere to any exposed surface of the mechanical device 600 and inadvertently to the apparatus 610. The paint 660 or other discoloration material may adhere to the thin film material 640 during the painting process and dry thereon afterwards. Once the paint 660 has dried, the thin film material 640 may be removed to expose the original and true color of the exterior layer 630. Of course, the thin film material 640 may be used in the same manner but for the purpose of preventing any textual message or depiction on the exterior layer 630 from being covered due to discoloration.

Figure 10:
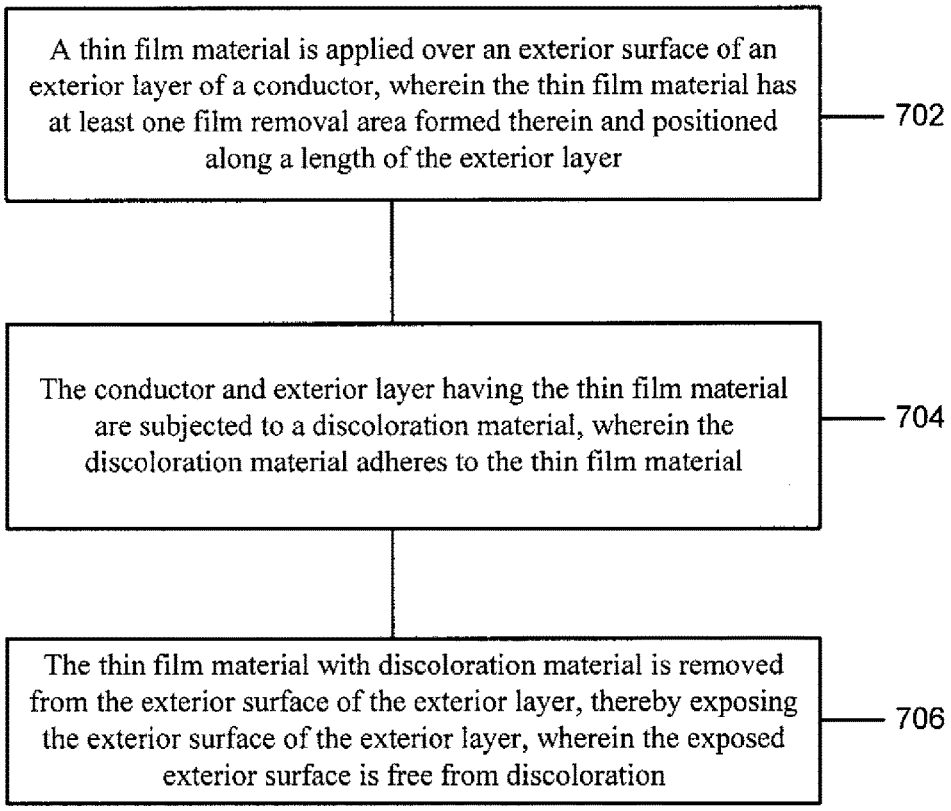
FIG. 10 is a flowchart illustrating a method of preventing discoloration damage to a cable, in accordance with an eighth exemplary embodiment of the present disclosure.

FIG. 10 is a flowchart 700 illustrating a method of preventing discoloration damage to a cable, in accordance with an eighth exemplary embodiment of the present disclosure. It should be noted that any process descriptions or blocks in flow charts should be understood as representing modules, segments, portions of code, or steps that include one or more instructions for implementing specific logical functions in the process, and alternate implementations are included within the scope of the present disclosure in which functions may be executed out of order from that shown or discussed, including substantially concurrently or in reverse order, depending on the functionality involved, as would be understood by those reasonably skilled in the art of the present disclosure.

As is shown by block 702, a thin film material is applied over an exterior surface of an exterior layer of a conductor, wherein the thin film material has at least one film removal area formed therein and positioned along a length of the exterior layer. The conductor and exterior layer having the thin film material are subjected to a discoloration material, wherein the discoloration material adheres to the thin film material (block 704). The thin film material with discoloration material is removed from the exterior surface of the exterior layer, thereby exposing the exterior surface of the exterior layer, wherein the exposed exterior surface is free from discoloration (block 706).

The method may further include any number of additional steps or processes, including any of the steps, processes, or functions described with respect to any embodiment of this disclosure. For example, the thin film material may be formed on the exterior surface of the exterior layer with at least one of a pellet extrusion process and a ram extrusion process. The film removal area may be formed within the thin film material after the at least one film removal area is applied over the exterior surface of the exterior layer of the conductor. The discoloration material may include paint, particulate-based discoloration substance, and/or solvent, which may be applied to the thin film material during a manufacturing process of a mechanical apparatus.

It should be emphasized that the above-described embodiments of the present disclosure, particularly, any "preferred" embodiments, are merely possible examples of implementations, merely set forth for a clear understanding of the principles of the disclosure. Many variations and modifications may be made to the above-described embodiment(s) of the disclosure without departing substantially from the spirit and principles of the disclosure. All such modifications and variations are intended to be included herein within the scope of this disclosure and the present disclosure and protected by the following claims.

What is claimed is:

1. A cable apparatus comprising:

a conductor;

an exterior layer surrounding the conductor, wherein the exterior layer is of a given color;

a thin film material removably positioned over an exterior surface of the exterior layer, wherein the thin film material is said given color;

at least one film removal area formed within the thin film material, wherein the at least one film removal area is positioned along a length of the exterior layer; and a discoloration material positioned over an outer surface of the thin film material, whereby the discoloration material is not native to the cable apparatus and at least partially obstructs visual identification of the given color of the thin film material.

2. The cable apparatus of claim 1, further comprising an adhesive material positioned between the exterior layer and the thin film material.

3. The cable apparatus of claim 1, wherein the exterior layer comprises a durable cable jacket.

4. The cable apparatus of claim 3, wherein the durable cable jacket comprises a metallic armor jacket.

5. The cable apparatus of claim 1, wherein the thin film material is substantially translucent, wherein the given color of the exterior layer is visually identifiable when viewed through the substantially translucent thin film material.

6. The cable apparatus of claim 1, wherein the thin film material is substantially translucent, wherein a textual marking on the exterior layer is visually identifiable when viewed through the substantially translucent thin film material.

7. The cable apparatus of claim 1, wherein a thickness of the thin film material is less than a thickness of the exterior layer.

8. The cable apparatus of claim 1, wherein the thin film material comprises at least one of a thermoset and thermoplastic material.

9. The cable apparatus of claim 1, wherein the thin film material comprises at least one of Polypropylene (PP), Polyethylene (PE), Ethylene vinyl acetate (EVA), Ethylene ethyl acrylate (EEA), polyvinyl chloride (PVC), thermoplastic rubber (TPR), thermoplastic Vulcanizate (TPV), thermoplastic elastomers (TPE), Fluorinated ethylene propylene (PEP), perfluoroalkoxy (PFA), Ethylene tetrafluoroethylene (ETFE), Ethylene chlorotrifluoroethylene (ECTFE), Urethane, polyvinylidene difluoride (PVDF), Polyether Imide (PEI), Polyphenylene oxide (PPO), Polyphenylene Ether (PPE), Polysulfone (PSU), Polyarylsulfones (PPSU), Chlorinated polyethylene (CPE), Polyimide, Polyamide, Ethylene-Propylene Elastomer (EPR), ethylene-octene (EO), electron beam (EB), Polyolefin, linear low-density polyethylene (LLDPE), linear high-density polyethylene (LHDPE), linear low-density polypropylene (LLDPP), linear high-density polypropylene (LHDPP), and perfluoro methyl alkoxy (MFA).

10. The cable apparatus of claim 1, wherein the at least one film removal area comprises a perforated slit.

11. The cable apparatus of claim 1, wherein the at least one film removal area comprises a weakened region of the thin film material, wherein the weakened region is positioned along the length of the exterior layer.

12. The cable apparatus of claim 1, wherein the at least one film removal area comprises an overlapped portion of thin film material, wherein a first portion of the thin film material is positioned overlapped on a second portion of the thin film material.

13. The cable apparatus of claim 12, further comprising an adhesive material positioned between the first portion and the second portion of the thin film material.

14. The cable apparatus of claim 1, wherein the at least one film removal area comprises two film removal areas positioned opposite one another across the cable apparatus and running parallel to each other along the length of the exterior layer.

15. A cable apparatus comprising:

a conductor;

an exterior layer surrounding the conductor, wherein the exterior layer provides a visually identifiable characteristic indicative of a purpose of the cable apparatus;

a sacrificial layer removably positioned over an exterior surface of the exterior layer, wherein the sacrificial layer provides the same visually identifiable characteristic indicative of the purpose of the cable apparatus as the exterior layer;

at least one film removal area formed within the sacrificial layer, wherein the at least one film removal area is positioned along at least a portion of a length of the exterior layer; and a discoloration material positioned over an outer surface of the sacrificial layer, wherein the discoloration material is not native to the cable apparatus and obstructs visual identification of the visually identifiable characteristic of the exterior layer.

16. The cable apparatus of claim 15, wherein the sacrificial layer includes:

a weakened region having a first material; and a remaining portion having a second material;

wherein the first material includes a weaker substance than the second material.

17. The cable apparatus of claim 15, wherein the sacrificial layer includes:

a weakened region having a first thickness; and a remaining portion having a second thickness;

wherein the first thickness is less than the second thickness.

18. The cable apparatus of claim 15, wherein each of the exterior layer and the thin film material includes at least one of a marking, a texture, a depiction, and a textual instruction indicative of the purpose of the cable apparatus.

19. The cable apparatus of claim 18, wherein the discoloration material comprises at least one of paint, grease, dye, a solvent, and dirt.

20. The cable apparatus of claim 1, wherein the discoloration material comprises at least one of paint, grease, dye, a solvent, and dirt.

* * * * *